US010566147B2

(12) United States Patent
Burkett

(10) Patent No.: US 10,566,147 B2
(45) Date of Patent: Feb. 18, 2020

(54) PHYSICAL BARRIER BREACH SENSOR

(71) Applicant: Karl A. Burkett, Austin, TX (US)

(72) Inventor: Karl A. Burkett, Austin, TX (US)

( * ) Notice: Subject to any disclaimer, the term of this patent is extended or adjusted under 35 U.S.C. 154(b) by 0 days.

(21) Appl. No.: 15/452,682

(22) Filed: Mar. 7, 2017

(65) Prior Publication Data

US 2018/0330896 A1 Nov. 15, 2018

(51) Int. Cl.

| | |
|---|---|
| ***H01H 19/14*** | (2006.01) |
| ***H01H 3/02*** | (2006.01) |
| ***H01R 13/66*** | (2006.01) |
| ***H01R 13/713*** | (2006.01) |
| *H01R 13/52* | (2006.01) |
| *H01R 13/703* | (2006.01) |
| *H01H 3/00* | (2006.01) |
| *H01R 13/502* | (2006.01) |

(52) U.S. Cl.

CPC ..... *H01H 3/02* (2013.01); *H01R 13/6683* (2013.01); *H01R 13/7137* (2013.01); *H01H 2003/007* (2013.01); *H01H 2003/0286* (2013.01); *H01R 13/502* (2013.01); *H01R 13/5213* (2013.01); *H01R 13/703* (2013.01)

(58) Field of Classification Search

CPC ..... H01H 13/186; H01H 1/26; H01H 3/04; H01H 13/14; H01H 21/24; H01H 21/285; H01H 2003/0233; H01H 2300/052; H01H 3/02; H01H 2003/007; H01H 2003/0286; G08B 25/12; H01R 13/7137; H01R 13/6683; H01R 13/502; H01R 13/703; H01R 13/5213

USPC ..... 200/335, 338, 329, 343, 459, 47, 522, 200/300, 61.08

See application file for complete search history.

(56) References Cited

U.S. PATENT DOCUMENTS

| | | | | |
|---|---|---|---|---|
| 4,831,221 A * | 5/1989 | Yu | H01H 71/465 200/303 |
| 2009/0194402 A1* | 8/2009 | Mao | H01H 13/705 200/332 |
| 2016/0099121 A1* | 4/2016 | Rosati | B62M 25/08 200/61.12 |

FOREIGN PATENT DOCUMENTS

| | | | | |
|---|---|---|---|---|
| EP | 0592925 | * | 4/1994 | G08B 25/12 |

* cited by examiner

*Primary Examiner* — Ahmed M Saeed
(74) *Attorney, Agent, or Firm* — James J. Sterling

(57) ABSTRACT

A physical barrier breach sensor is disclosed that contains a frangible material that, upon displacement, opens a microswitch that de-energizes power or stops the flow of electricity to an electrical device. Displacement of the frangible material causes activation of the sensor, such as due to a vehicle colliding with a streetlight pole containing the sensor. The device is omnidirectional, operating regardless of direction of impact from the vehicle or activation, and has the ability to disconnect power when, for example, a streetlight pole or other structure (e.g., a parking gate) falls or breaks due to a shearing impact (such as a vehicle collision) or due to tension created by wind or weight failure.

11 Claims, 4 Drawing Sheets

PHYSICAL BARRIER BREACH SENSOR

BACKGROUND OF THE INVENTION

1. Technical Field

This invention relates to electrical devices, and more particularly, to an electrical device that may be used to determine when a physical barrier has been breached, for example, by a vehicle colliding with a structure.

2. Description of Related Art

Most, if not all, of the states and municipalities in the continental United States have poles such as light poles, sign post, or traffic signal poles that contain or support an electrical device. Often, the poles are equipped with a base that is intended to break away when impacted by an errant vehicle.

The breakaway base reduces the severity of the accident by reducing the errant vehicle's maximum change in momentum and allows the errant vehicle to continue on its path instead of being brought to a sudden stop.

Within the breakaway base there is typically a pull-apart wire disconnect wherein during a collision the wires are disconnected by a wire pull apart style disconnect device that depends on the wire terminal strength to pull the wires apart. The pulling apart of the wires turns off power or otherwise stops the flow of electricity to the wires going up to the electrical device attached to the pole. Unfortunately, often the wires have an extended length prior to and after they are pulled apart and once the wires are pulled apart, power is not removed from the wiring at the pole's foundation or foundation side of the disconnect. If the hot end of the wiring extending from the foundation side were to get wet, nicked, or snagged by the errant vehicle, there could be an immediate danger of electric shock or fire.

The inventor has obtained U.S. Pat. No. 7,790,995 for an electromechanical break-away switch that de-energizes power or stops the flow of electricity to a pole upon a vehicle colliding with the pole or other activation of the sensor. However, a new and improved electromechanical break-away switch has been developed that further increases the reliability of the disconnect action. In addition, the new and improved break-away switch has more potential application as a perimeter entry or physical barrier breach sensor.

BRIEF SUMMARY OF THE INVENTION

The present invention solves the above-described problems and limitations and permits a broader spectrum of applications in areas where sensing of physical barrier breach or breakage is desired.

BRIEF DESCRIPTION OF THE SEVERAL VIEWS OF THE DRAWING(S)

FIG. 2A is a view of an alternative embodiment of the physical barrier breach sensor after it has detected a physical barrier breach.

DETAILED DESCRIPTION OF THE INVENTION

Figure 1A:
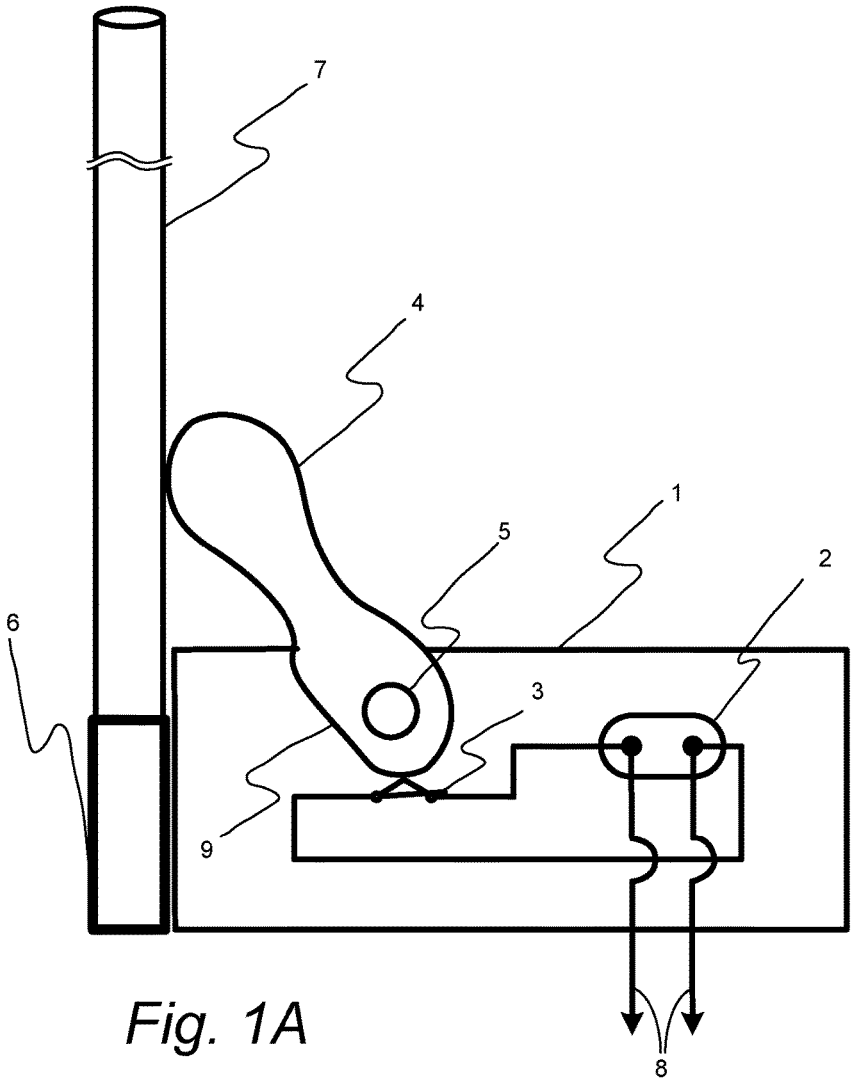
FIG. 1A is a view of an embodiment of the physical barrier breach sensor in normal operation.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Referring to FIG. 1A, shown is an embodiment of the physical barrier breach sensor. Enclosure 1 contains a terminal strip 2 that provides an electrical interface and strain relief between incoming wires 8 and microswitch 3, which may be physically installed inside or outside of enclosure 1. One of the incoming wires 8 will be connected to incoming electrical power, while the other will be connected to a collocated electrical device such as a street light. Sensor arm 4 is attached to a spring (not shown, but well known to persons in the art) which causes the sensor arm to rotate counterclockwise around pivot point 5 in the absence of a countervening force. Glass rod 7, of a length long enough to receive any significant force applied to the physical barrier (nominally 30 inches), is inserted in rod base 6. The presence of glass rod 7 prevents sensor arm 4 from rotating counterclockwise around pivot point 5. When sensor arm 4 is upright as shown in FIG. 1A, its shape compresses microswitch 3, holding it closed. Incoming wires 8 are now connected together in a circuit. This is the normal state of the physical barrier breach sensor.

Note that in FIG. 1A, the indentation 9 in sensor arm 4 is rotated away from microswitch 3. Glass rod 7 is made out of tempered glass. While strong, when significant force is applied, glass rod 7 will shatter into small fragments that will not present a cutting hazard to emergency responders and bystanders.

Figure 1B:
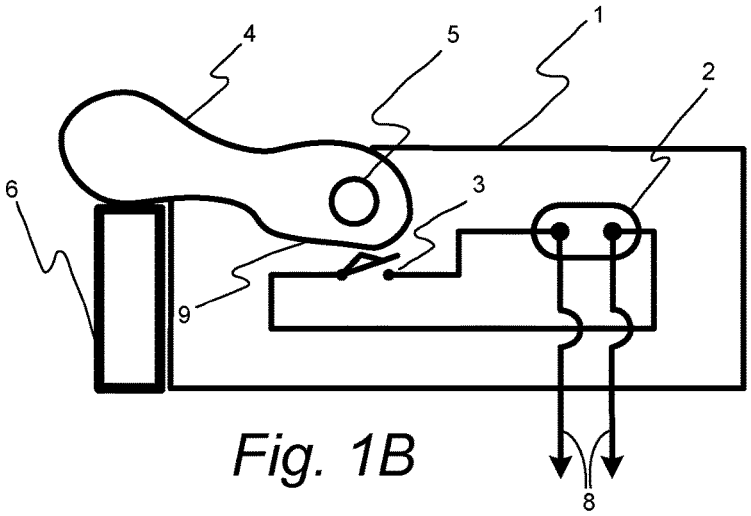
FIG. 1B is a view of an embodiment of the physical barrier breach sensor after it has detected a physical barrier breach.

Referring to FIG. 1B, glass rod 7 has broken due to significant external force being applied anywhere along its length. Sensor arm 4, propelled by the force of the attached spring (not shown), has now rotated counterclockwise around pivot point 4 to bring indentation 9 directly above microswitch 3. Microswitch 3 is no longer compressed by sensor arm 4, and opens, presenting an open circuit to wires 8. This interrupts electrical current flowing through wires 8, preventing power from flowing beyond the physical barrier breach sensor, and rendering any wire extending from the physical barrier breach sensor safe to emergency responders, crash victims, and bystanders. Alternatively, the open circuit can be detected locally or remotely, triggering an alarm condition. The loss of voltage condition may also be detected in conjunction with the interruption of electrical power, providing both a safe interruption of hazardous voltage and an alarm indication to trigger an emergency response and/or maintenance activity.

Figure 2A:
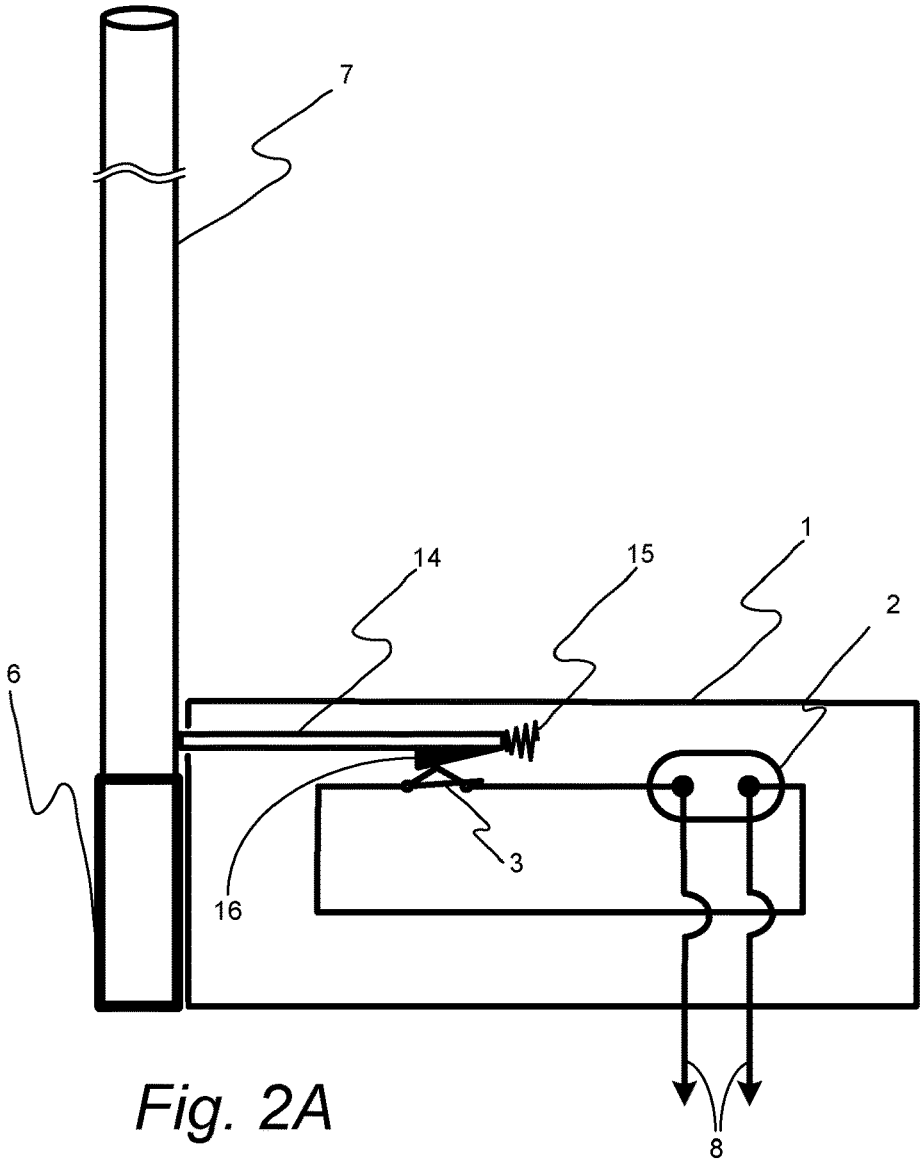
FIG. 2A is a view of an alternative embodiment of the physical barrier breach sensor in normal operation.

FIG. 2A shows an alternative embodiment of the physical barrier breach sensor. Plunger 14 protrudes through an opening in enclosure 1 and is held against glass rod 7 by compressed spring 15. Microswitch 3 is held closed by wedge 16 that is attached to plunger 14 or is a molded or formed integral part of plunger 14.

Figure 2B:
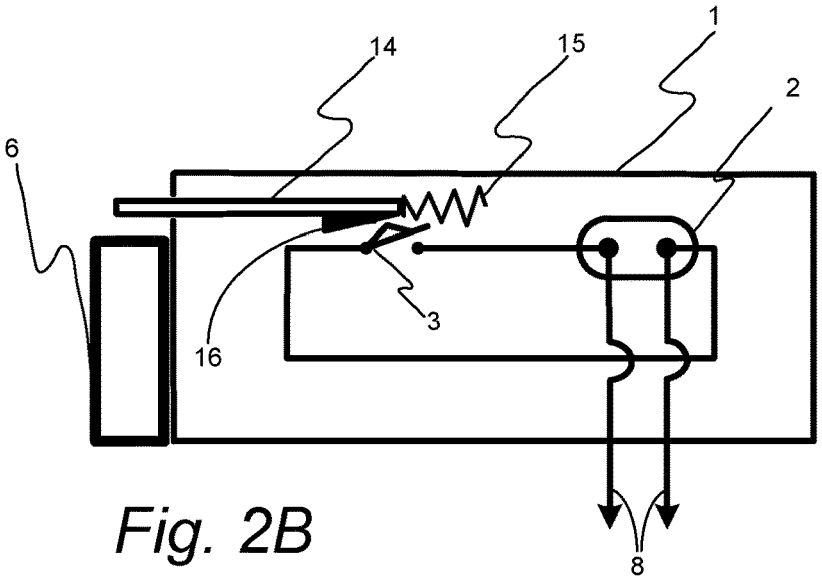

Referring to FIG. 2B, glass rod 7 has broken due to significant external force being applied anywhere along its length. Plunger 14, propelled by the force of spring 15, has now moved leftward to move wedge 16 from immediately above microswitch 3. Microswitch 3 is no longer compressed, and opens, presenting an open circuit to wires 8.

Figure 3:
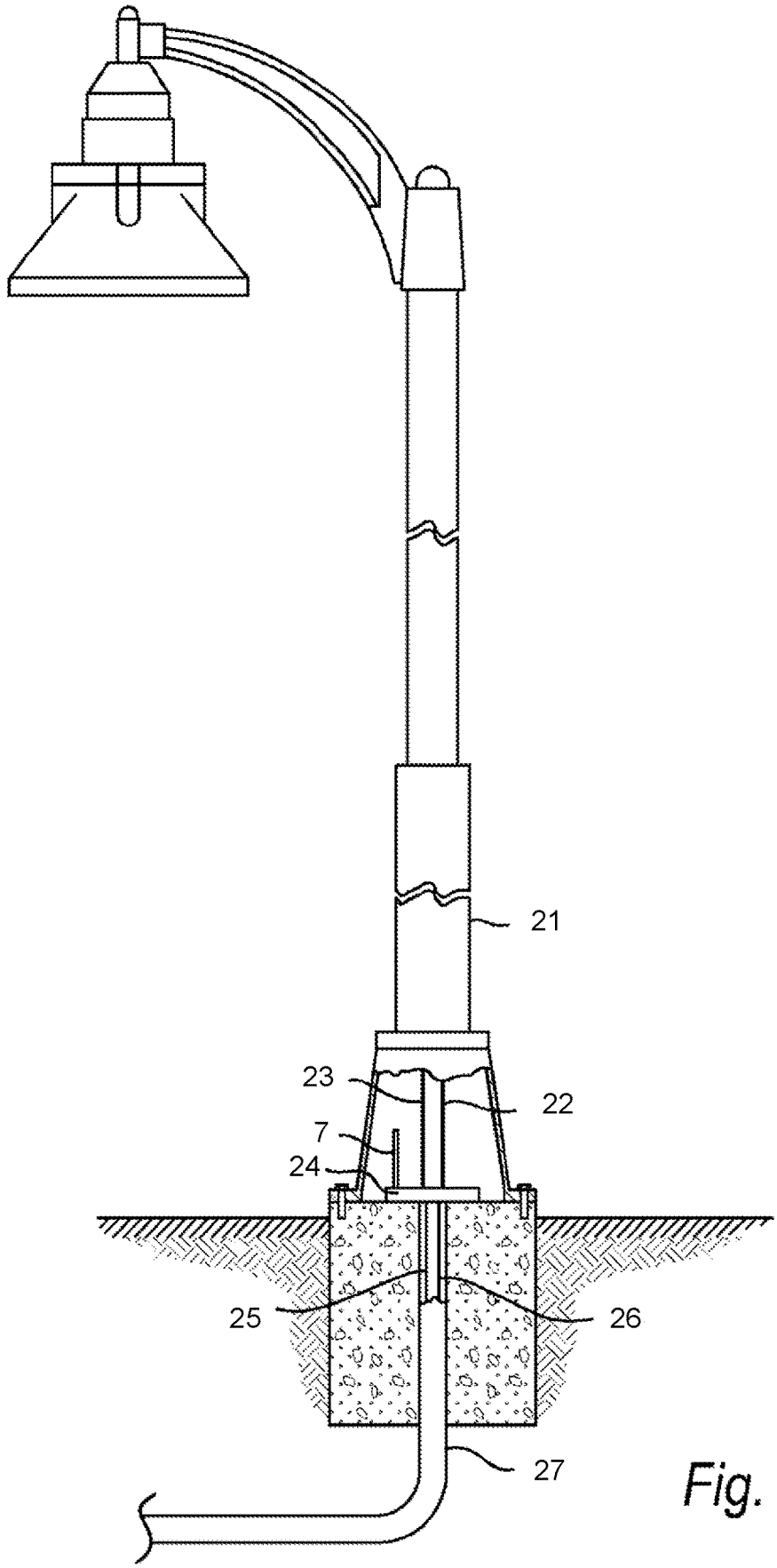
FIG. 3 is a view of the physical barrier breach sensor incorporated into a breakaway light standard.

FIG. 3 shows a physical barrier breach sensor installed in a commonly-deployed breakaway streetlight base. When, for example, a vehicle colliding with pole 21 causes it to topple or become disconnected from its mount, glass rod 7 will shatter, causing the microswitch in physical barrier breach sensor 24 to open and prevent electrical current from wires 25 and 26 in conduit 27 from traveling through wires 22 and 23.

Figure 4:
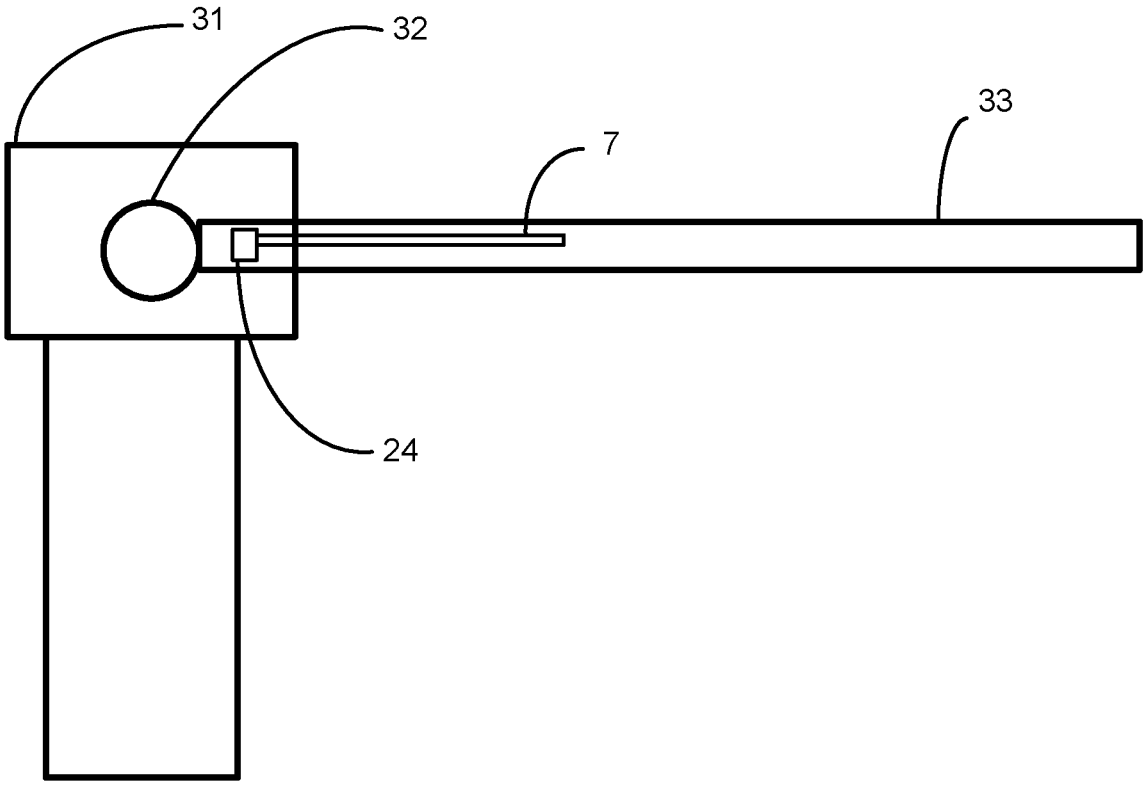
FIG. 4 is a view of the physical barrier breach sensor incorporated into a motorized gate arm, such as a vehicle gate to restrict access to or from a parking garage or area.

FIG. 4 shows a physical barrier breach sensor installed in an automated parking gate at the entrance to or exit from a parking lot or garage. In normal operation, gate motor 31 will raise and lower gate 33 by rotating shaft 32. If gate 33 is broken for any reason (such as a vehicle driving through the gate, or a person or persons manually breaking the gate open), glass rod 7 will break, triggering physical breach sensor 24. The interruption of electrical current to the gate can then disable the gate to avoid further damage, as well as trigger an alarm for a suitable emergency and/or maintenance response.

Modifications to the disclosure herein have been found to provide good results without departing from the claims. For example, glass rod 7 can be replaced by a narrow sheet of tempered glass at lower cost and without significant loss of performance.

The physical barrier breach sensor may also be used as a convenient lock-out device for field personnel to interrupt power at the electrical device by simply removing the glass rod or plate. When the field maintenance is completed, power can be restored by replacing the glass rod or plate, restoring the physical barrier breach sensor to full operation and re-energizing the attached electrical device.

I claim:

1. A physical barrier breach sensor comprising:

a frangible material portion substantially exposed to external forces exerted from any direction;

an operating arm disposed adjacent to said frangible material portion;

a spring attached to said operating arm in order to apply a force by said operating arm against said frangible material portion;

a microswitch disposed adjacent to said operating arm, said microswitch held electrically closed by proximity of said operating arm, wherein when said frangible shock detection material is broken by the imposition of an external force exerted from any direction, said operating arm is propelled by said spring, causing said microswitch to open.

2. A physical barrier breach sensor comprising:

a glass rod substantially exposed to external forces exerted from any direction;

an operating arm, with one end rotably attached to a pivot point and the other end disposed adjacent to said glass rod;

a spring attached to said operating arm to cause said operating arm to rotate around said pivot point in the absence of said glass rod;

a microswitch disposed adjacent to the operating arm, said microswitch held electrically closed by proximity of said operating arm, wherein when said glass rod is broken by the imposition of an external force exerted from any direction, said operating arm rotates around said pivot point, causing the microswitch to open.

3. A physical barrier breach sensor comprising:

a glass plate substantially exposed to external forces exerted from any direction;

an operating arm, with one end rotably mounted to a pivot point and the other end disposed adjacent to said glass plate;

a spring attached to said operating arm to cause said operating arm to rotate around said pivot point in the absence of said glass plate;

a microswitch disposed adjacent to the operating arm, said microswitch held electrically closed by proximity of said operating arm, wherein when said glass plate is broken by the imposition of an external force exerted from any direction, said operating arm rotates around said pivot point, causing the microswitch to open.

4. The physical barrier breach sensor as in claim 1, wherein said frangible material portion is a glass rod.

5. The physical barrier breach sensor as in claim 1, wherein said frangible material portion is a glass plate.

6. The physical barrier breach sensor as in claim 1, wherein said operating arm comprises a linearly-activated plunger.

7. The physical barrier breach sensor as in claim 1, wherein said operating arm comprises a flat elongated member, said flat elongated member rotably attached at one end to a pivot point so that when said frangible material portion is broken, said flat elongated member rotates around said pivot point.

8. The physical barrier breach sensor as in claim 5, wherein said operating arm comprises a linearly-activated plunger.

9. The physical barrier breach sensor as in claim 5, wherein said operating arm comprises a flat elongated member, said flat elongated member rotably attached at one end to a pivot point so that when said frangible material portion is broken, said flat elongated member rotates around said pivot point.

10. The physical barrier breach sensor as in claim 6, wherein said operating arm comprises a linearly-activated plunger.

11. The physical barrier breach sensor as in claim 6, wherein said operating arm comprises a flat elongated member, said flat elongated member rotably attached at one end to a pivot point so that when said frangible material portion is broken, said flat elongated member rotates around said pivot point.

* * * * *